United States Patent [19]

Deborde et al.

[11] Patent Number: 4,479,519

[45] Date of Patent: Oct. 30, 1984

[54] WEFT BRAKE FOR SHUTTLELESS LOOM

[75] Inventors: Albert H. Deborde; Max Guallo, both of Bourgoin Jallieu, France

[73] Assignee: Saurer Diederichs (Societe Anonyme), Bourgoin Jallieu, France

[21] Appl. No.: 400,670

[22] Filed: Jul. 22, 1982

[30] Foreign Application Priority Data

Jul. 23, 1981 [FR] France ..... 81 14793

[51] Int. Cl.[3] ..... D03D 47/30

[52] U.S. Cl. ..... 139/450; 66/146; 112/155

[58] Field of Search ..... 139/194, 429, 450, 453; 66/146; 112/154, 155; 242/150

[56] References Cited

U.S. PATENT DOCUMENTS

| | | | |
|---|---|---|---|
| 3,340,903 | 9/1967 | Golobart | 139/450 |
| 3,378,040 | 4/1968 | Moessinger | 139/450 |
| 4,192,357 | 3/1980 | Tanaka et al. | 139/429 |
| 4,351,370 | 9/1982 | Guy et al. | 139/429 |

FOREIGN PATENT DOCUMENTS

| | | |
|---|---|---|
| 258228 | 2/1967 | Austria . |
| 39561 | 11/1981 | European Pat. Off. . |
| 2143641 | 12/1974 | Fed. Rep. of Germany . |
| 1161662 | 3/1958 | France . |
| 2375366 | 7/1978 | France . |
| 310476 | 2/1973 | Switzerland . |
| 531979 | 2/1973 | Switzerland . |

*Primary Examiner*—Henry Jaudon

*Attorney, Agent, or Firm*—Karl F. Ross; Herbert Dubno

[57] ABSTRACT

A weft brake for a loom, especially for one of the shuttleless type, comprises a stationary blade and a movable blade cantilevered in overlapping positions on respective posts rising from a supporting plate, the free end of the movable blade being spring-biased toward the stationary blade for clamping a weft thread therebetween but being periodically deflected away therefrom for releasing the weft thread to facilitate its transportation through the shed of the associated warp threads. The weft thread passes between the stationary blade and a leaf spring forming an intermediate blade, inserted between the two other blades of the brake and cantilevered on the same post as the movable blade, so as to be frictionally restrained by the elasticity of that intermediate blade in the unclamping position of the movable blade.

6 Claims, 4 Drawing Figures

WEFT BRAKE FOR SHUTTLELESS LOOM

FIELD OF THE INVENTION

Our present invention relates to a thread brake as used on the weft of a loom, particularly one of the shuttleless type in which a weft thread is to be transported through a shed of associated warp threads by an insertion lance or rapier traversing the shed, or by two such rapiers between which the weft thread is transferred in the middle of the shed.

BACKGROUND OF THE INVENTION

When a weft thread is being transported in the aforedescribed manner through the shed of a shuttleless loom, it is to be held taut especially at the instants of engagement of and disengagement from a rapier. For this purpose, it is already known to use weft brakes disposed laterally of a loom which grip the oncoming thread between two jaws and release it during its entrainment by the rapier. Usually one of the jaws is stationary while the other is movable and urged under a spring force against the first jaw; this second, movable jaw is intermittently deflected by a control pin, synchronized with the warp-engaging heddles and with the weft-transport mechanism, to separate it from the first jaw.

A drawback of the known weft brake is that the thread is completely uncontrolled upon being unclamped. The separation of the jaws, moreover, enables the entry of accompanying lint into the brake where particles thereof may accumulate and interfere with its operation. Furthermore, the impact of the sudden release of the movable jaw from its unclamping position may be harmful to the thread if the jaw is strongly spring-loaded as is required for firm clamping.

OBJECT OF THE INVENTION

The object of our present invention, therefore, is to provide an improved weft brake obviating these inconveniences.

SUMMARY OF THE INVENTION

We realize this object, in accordance with our present invention, by providing such a weft brake with a leaf spring interposed between its stationary and movable jaws for gripping the weft thread between the leaf spring and the stationary jaw in a clamping position and for engaging the weft thread under reduced pressure in an unclamping position of the movable jaw. Thus, the weft thread is still frictionally restrained during its entrainment by a transporter such as a rapier and any accompanying lint is smoothed against the thread surface so as not to accumulate within the brake.

When the stationary jaw is a first blade cantilevered on a first post rising from a supporting surface while the movable jaw is a second blade cantilevered on a second post rising from the same surface at a distance from the first post, the leaf spring is advantageously cantilevered on the second post to extend codirectionally with the second, movable blade toward the first post. This movable blade will then have a free end projecting beyond a free end of the leaf spring for engagement by the associated control means while the first blade extends toward the second post and closely approaches the leaf spring at an intermediate location between the two posts.

BRIEF DESCRIPTION OF THE DRAWING

The above and other features of the invention will now be described in detail with reference to the accompanying drawing in which.

SPECIFIC DESCRIPTION

Figure 1:
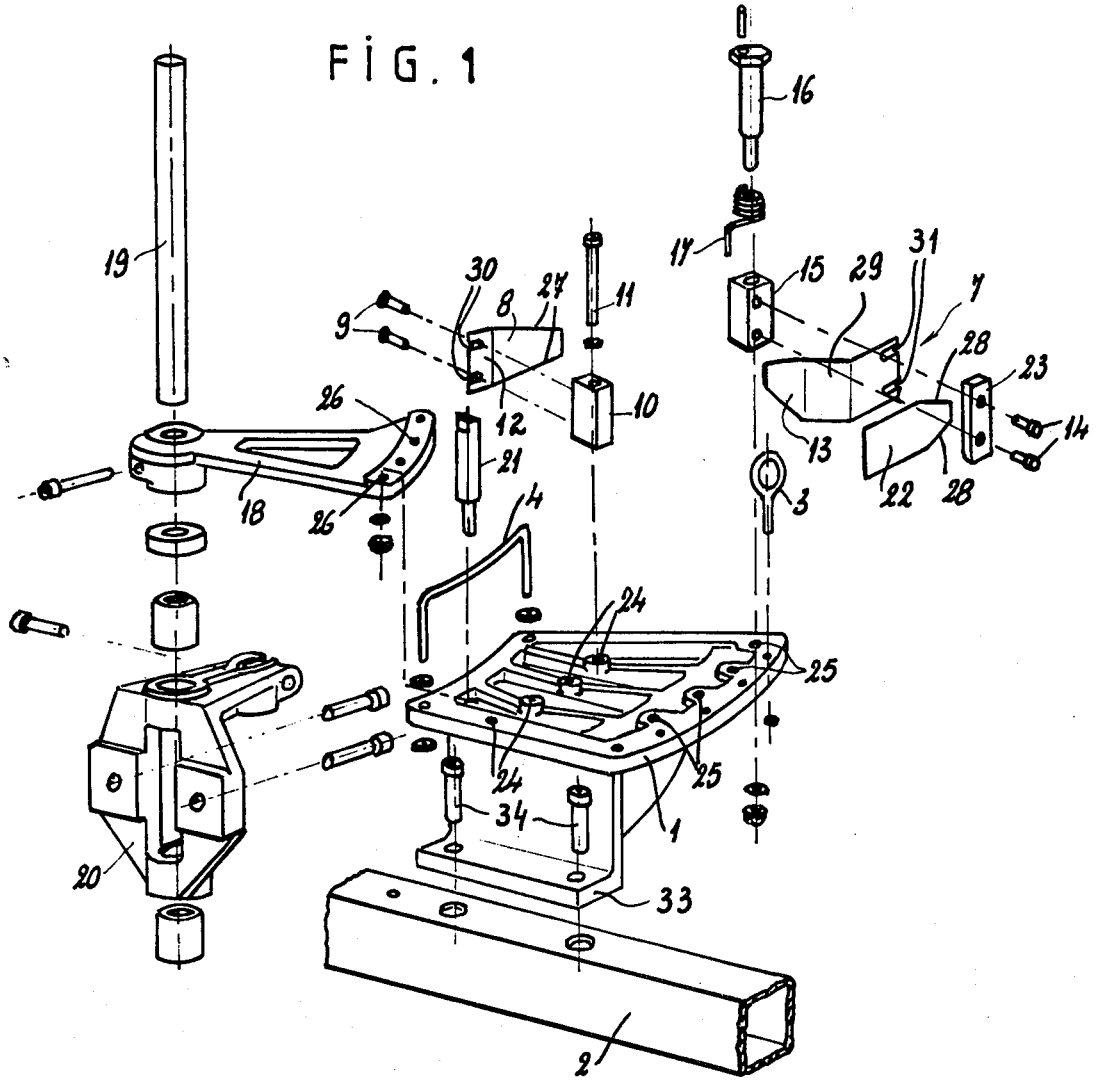
FIG. 1 is an exploded perspective view of an improved weft brake according to out invention along with associated elements of a shuttleless loom.

The components of a shuttleless loom illustrated in the drawing include a stationary mounting plate 1 fastened by a bracket 33 and screws 34 to a beam 2 forming part of the loom frame. Mounting plate 1, disposed laterally of a nonillustrated set of warp threads, supports four eyes 3 and a gate 4 establishing guidepaths for four weft threads 5 drawn off respective supply bobbins 6 (only one shown). A weft brake 7, associated with one of the threads 5 but representative of a set of four such brakes, comprises a stationary jaw in the form of an essentially flat blade 8, a movable jaw in the form of an angularly bent blade 13 and an intervening blade 22 designed as a leaf spring of arcuate curvature. A fixed, laterally bent end 12 of stationary blade 8 has two notches 30 accommodating respective screws 9 by which that blade is secured in cantilever fashion to a post 10 which is fastened by a bolt 11 to mounting plate 1. Blade 8 has longitudinal edges 27 tapering toward its free end which points in the direction of the oncoming weft thread 5. Movable blade 13 similarly has a fixed end 29 provided with notches 31 giving passage to a pair of screws 14 which traverse a retaining plate 23 and bracket tapering flanks 28 of a fixed end of leaf spring 22 while engaging a post 15 which rises from mounting plate 1 at a distance from post 10 and is secured to that mounting plate by a bolt 16 further traversing a coil spring 17. The two blades 13 and 22 are thereby fastened, also in cantilever fashion, to the post 15 with their free ends extending toward post 10, i.e. in the direction of advance of the associated weft thread 5. The free end of blade 13 projects in that direction beyond the free end of blade 22 into the path of an associated control pin 21 rising from a sector 18 which is fulcrumed by a vertical shaft 19 on a journal bearing 20. Sector 18, carrying four control pins 21 to coact with the movable blades of all four weft brakes, is periodically oscillated about its pivot 19 by a nonillustrated cam synchronized with the loom drive. Sockets 24 on mounting plate 1 accommodate the fastening bolts (11) of the posts (10) for the stationary blades of the remaining three brakes whose other posts (15) are held in position by bolts (16) passing through bores 25 of blade 1. The control pins 21 are received in bores 26 of the oscillating sector 18.

Figure 4:
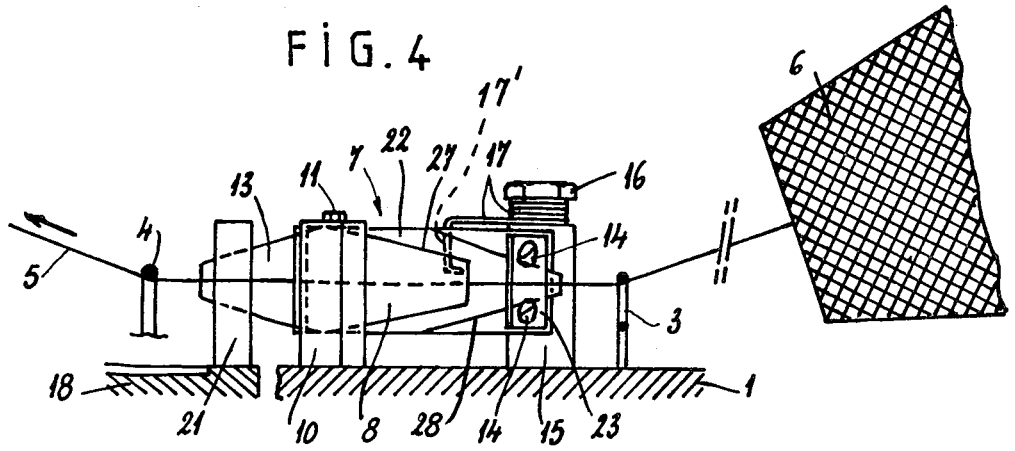
FIG. 4 is a side-elevational view of our improved brake.
Figure 2:
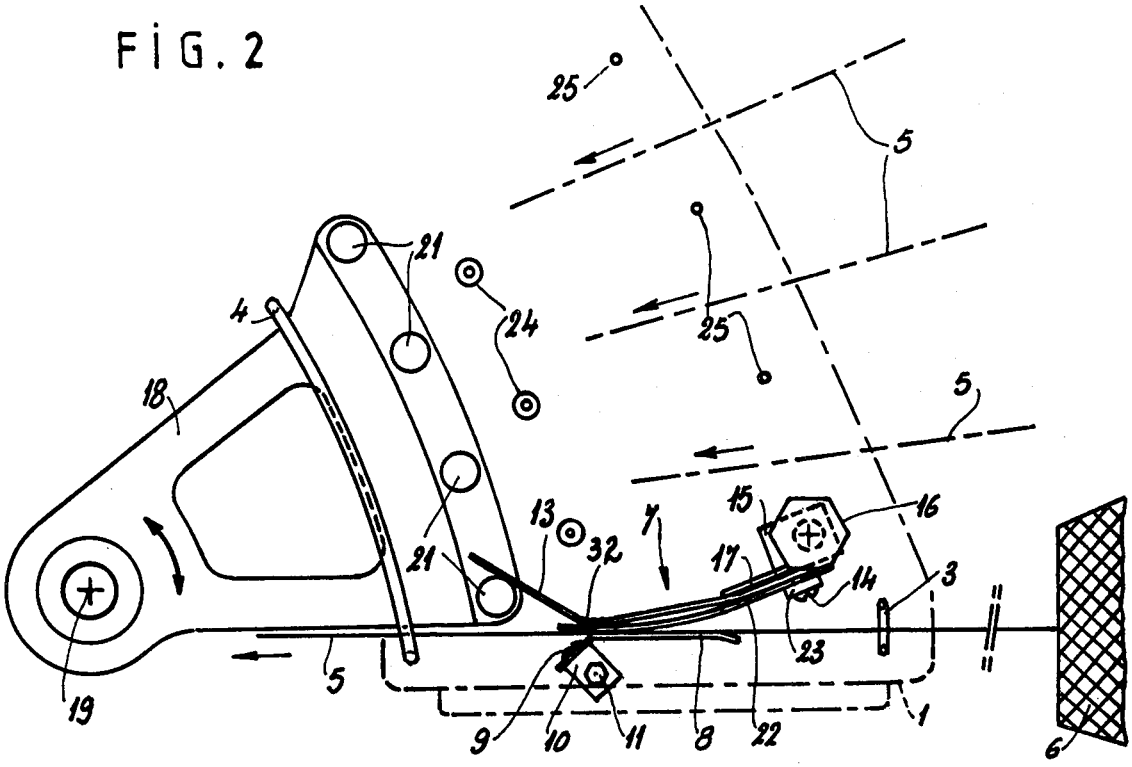
FIG. 2 is a plan view of the components of FIG. 1 in an assembled state, showing the brake in its clamping position.
Figure 3:
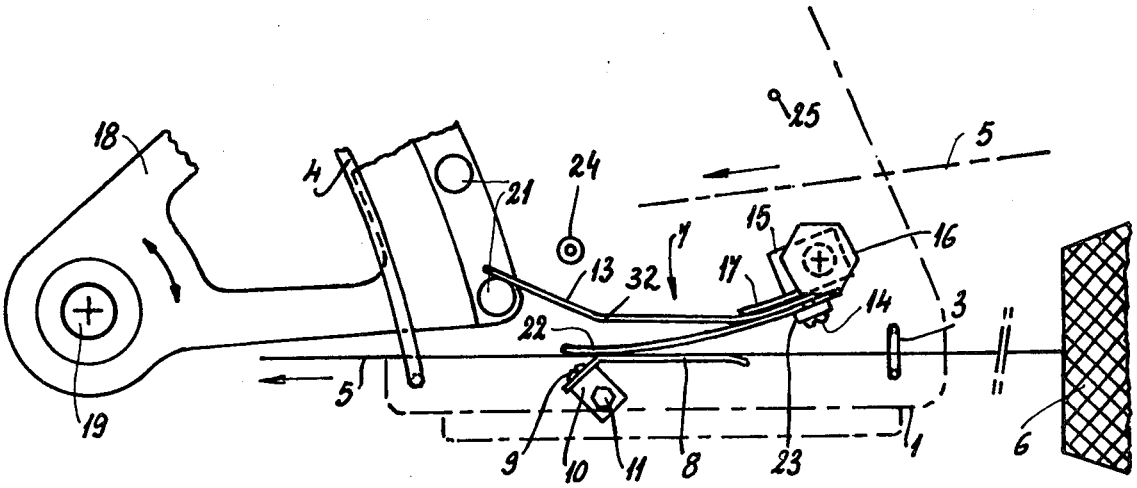
FIG. 3 is a view similar to that of FIG. 2, showing the brake in its unclamping position.

In a clamping position of brake 7, as illustrated in FIG. 2, a bend 32 of movable blade 13 bears upon the concave side of intermediate blade 22 under the pressure of coil spring 17 which has a bent-over extremity 17' engaging behind the blade 13 as seen in FIG. 4. The point of contact between blades 13 and 22, defined by the bend 32, lies between the two posts 10, 15 at a location close to post 10. At this point the curved leaf spring 22 is pressed with its convex side into firm contact with stationary blade 8 to clamp the thread 5 therebetween. When sector 18 swings counterclockwise from the position of FIG. 2 to that of FIG. 3, the movable blade 13 is separated from the associated blades 8 and 22—as are corresponding blades of all other brakes—whereby leaf spring 22 exerts only a residual pressure, due to its inherent resiliency, upon the weft thread 5 which is therefore entrainable in the direction of the arrow by a nonillustrated rapier engaging same. The free end of blade 8 diverges from blades 13 and 22 in the direction of the oncoming weft thread 5 so as to facilitate the initial insertion of that thread between the brake jaws; that insertion is further facilitated by the fact that the height of blade 8 in the region of its free end is reduced, thanks to its tapering edges 27, with reference to the height of the adjoining leaf spring 22.

While our improved thread brake has been particularly described with reference to its use on a weft of a shuttleless loom, its utility is not limited to this mode of application.

We claim:

1. In a loom provided with a supply of weft thread to be transported through a shed of warp threads, guide means defining a transport path for said weft thread, a thread brake in said transport path provided with a stationary jaw and a movable jaw resiliently biased toward said stationary jaw for clamping said weft thread therebetween, and control means intermittently engageable with said movable jaw for separating same from said stationary jaw to unclamp the weft thread engaged thereby, the improvement wherein said thread brake further comprises a leaf spring interposed between said stationary and movable jaws for gripping said weft thread between said leaf spring and said stationary jaw in a clamping position of said movable jaw and for engaging said weft thread under reduced pressure in an unclamping position of said movable jaw.

2. In a loom provided with a supply of weft thread to be transported through a shed of warp threads, guide means defining a transport path for said weft thread, a thread brake in said transport path provided with a stationary jaw and a movable jaw resiliently biased toward said stationary jaw for clamping said weft thread therebetween, and control means intermittently engageable with said movable jaw for separating same from said stationary jaw to unclamp the weft thread engaged thereby, the improvement wherein said thread brake further comprises a leaf spring interposed between said stationary and movable jaws for gripping said weft thread between said leaf spring and said stationary jaw in a clamping position of said movable jaw and for engaging said weft thread under reduced pressure in an unclamping position of said movable jaw, said stationary jaw being a first blade cantilevered on a first post rising from a supporting surface and said movable being a second blade cantilevered on a second post rising from said surface at a distance from said first post, said leaf spring being cantilevered on said second post and extending codirectionally with said second blade toward said first post, said second blade having a free end projecting beyond a free end of said leaf spring for engagement by said control means, said first blade extending toward said second post and closely approaching said leaf spring at an intermediate location between said posts.

3. A thread brake as defined in claim 2 wherein said first blade is essentially flat, said leaf spring being arcuately curved with a convex side facing said first blade, said second blade having a bend bearing upon a concave side of said leaf spring at a point near said intermediate location in said clamping position.

4. A thread brake as defined in claim 2 or 3 wherein said second blade is biased toward said first blade by an end of a coil spring mounted on said second post.

5. A thread brake as defined in claim 2 or 3 wherein said second blade has a fixed end fastened to said second post by a retaining plate traversed by a pair of screws spaced apart in a direction normal to said supporting surface, said leaf spring having a tapering extremity bracketed by said screws and inserted between said retaining plate and said second blade.

6. A thread brake as defined in claim 5 wherein said tapering extremity is pointed toward said supply of weft thread.

* * * * *